US008541937B2

(12) United States Patent
Zhang

(10) Patent No.: US 8,541,937 B2
(45) Date of Patent: Sep. 24, 2013

(54) LAMP FOR USE IN LIGHT STRINGS

(76) Inventor: Bing Zhang, Hubei Province (CN)

( * ) Notice: Subject to any disclaimer, the term of this patent is extended or adjusted under 35 U.S.C. 154(b) by 0 days.

(21) Appl. No.: 13/110,906

(22) Filed: May 18, 2011

(65) Prior Publication Data

US 2012/0025694 A1 Feb. 2, 2012

(51) Int. Cl.
*H01J 5/48* (2006.01)

(52) U.S. Cl.
USPC ..... 313/318.01; 313/318.05; 362/654

(58) Field of Classification Search
USPC ..... 313/318.01, 318.05
See application file for complete search history.

(56) References Cited

U.S. PATENT DOCUMENTS 6,257,740 B1 * 7/2001 Gibboney, Jr. ..... 362/288
6,347,965 B1 * 2/2002 Pan ..... 439/699.2
6,805,463 B2 * 10/2004 Shieh ..... 362/653
7,381,070 B2 * 6/2008 Foo ..... 439/188
7,453,194 B1 * 11/2008 Gibboney ..... 313/318.1
7,554,266 B1 * 6/2009 Chen ..... 313/580
8,235,737 B2 * 8/2012 Cheng et al. ..... 439/188
2006/0146578 A1 * 7/2006 Kuo ..... 362/654
2006/0274556 A1 * 12/2006 Massabki et al. ..... 362/652
2008/0130284 A1 * 6/2008 Altamura et al. ..... 362/251
2008/0239758 A1 * 10/2008 Ng ..... 362/659
2009/0073685 A1 * 3/2009 Pan ..... 362/227

* cited by examiner

*Primary Examiner* — Sikha Roy
(74) *Attorney, Agent, or Firm* — Baker & McKenzie LLP

(57) ABSTRACT

A lamp for use in light strings comprises an LED lamp, a lamp stem connected with the LED lamp and a lamp holder in which the lamp stem is arranged, wherein the lamp holder is internally provided with a conductive element electrically connected with wires, the LED lamp is connected with the conductive element through the lamp stem, the conductive element comprises a first conductive element and a second conductive element which are positioned at the left side and the right side in the lamp holder, the lower part of the lamp stem is provided with a protruded end which is clamped between the two conductive elements, the inner wall of the lamp holder is provided with an elastic element which can enable the two conductive elements to be contacted with and conductive with current when the lamp stem is pulled out.

7 Claims, 7 Drawing Sheets

LAMP FOR USE IN LIGHT STRINGS

BACKGROUND OF THE INVENTION

The utility model relates to a lamp for use in light strings.

At present, Christmas lamps in the market comprise an LED lamp, a lamp stem, a conductive element and wires; if the lamp has faults and can not normally work, or when the LED lamp falls from or is pulled out of the lamp holder, the whole serial string lamp connected with the lamp has an open circuit to put out so as to bring inconvenience to the users. Thereby, the manufacturer of the Christmas lamp developed an electronic and mechanical shunting device for solving the above defects, the electric shunting device is formed in a way that an electric element is arranged in the lamp holder to be connected with the LED lamp in parallel so as to realize the independent power supply of the lamp, the normal work of other lamps can not be influenced when one lamp has faults, but the electric element has a high cost, is inconvenient to manufacture, and increases the production cost of the enterprises; however, the mechanical shunting device has a relatively low price, and realizes current shunting by the way that conductive elements are arranged in the lamp holder to mutually contact; when the LED lamp is in the lamp holder, the lower part of the lamp stem separates the elastic elements not to be mutually contacted, at this time the LED lamp normally works, the current flows through the LED lamp to be conductive with other lamps of the string lamp; when the LED lamp has faults and is pulled out, the elastic conductive elements oppositely move under the action of their own elastic force to be mutually contacted and conductive for current shunting, the lamp with the structure realizes the current shunting function, but the manufacture is more difficult, the elastic conductive elements are not easy to install in the lamp holder, and during the manufacture and the transportation processes, the elastic conductive elements are easy to crush and deform so as to lose tension, so that the elastic conductive elements can not effectively rebound to be mutually contacted to be conductive with current when being installed in the lamp holder.

BRIEF SUMMARY OF THE INVENTION

The utility model aims to overcome the defects in the prior art, and provides a lamp for use in light strings which is convenient to install, manufacture and has the shunting function so as to realize that the lamps connected at the front and back of the string lamp can be conductive with the current to normally work after one LED lamp has faults and is taken out.

In order to realize the above aim, the technical scheme of the utility model is that:

A lamp for use in light strings comprises an LED lamp, a lamp stem connected with the LED lamp and a lamp holder in which the lamp stem is arranged, wherein the lamp holder is internally provided with a conductive element electrically connected with wires, the LED lamp is connected with the conductive element through the lamp stem, the conductive element comprises a first conductive element and a second conductive element which are positioned at the left side and the right side in the lamp holder, the lower part of the lamp stem is provided with a protruded end, the protruded end is clamped between the two conductive elements, the two lamp bases of the LED lamp are respectively contacted with and conductive with the two conductive elements, and the inner wall of the lamp holder is provided with an elastic element which can enable the two conductive elements to be contacted to be conductive with the current.

The above one end of each conductive element is fixedly clamped in the lamp holder to respectively form fixed ends contacted with the lamp bases of the LED lamp, the other ends of the conductive elements are suspended movable ends connected with the wire, and the elastic element is positioned with the gaps among the inner wall of the lamp holder and the movable ends of the conductive elements.

The above movable ends of the two conductive elements are fully enclosed or semi-enclosed on wires, and the side walls of the movable ends of the two conductive elements, which are mutually closed, are electric contacts which can realize the electric conduction.

A sheet metal I which can enable the electric contacts of the movable ends of the two conductive elements to be conductive is arranged between the above movable ends of the two conductive elements.

A clamping slot is arranged in the above lamp holder, and the sheet metal I is directly arranged in the clamping slot to be fixed.

The above sheet metal I is linear, G-shaped or inverted U-shaped.

The above lamp holder is internally provided with a sheet metal II which can enable the electric contacts of the movable ends of the two conductive elements to be conductive, and the sheet metal II is respectively contacted with the front sides or the back sides of the first conductive element and the second conductive element.

Compared with the prior art, the advantageous effects of the utility model are as follows:

In the lamp of the utility model, the protruded end of the lamp stem separates the two conductive elements, at the same time, the two lamp bases of LED lamp are contacted with the two conductive elements, the current flows through the LED lamp to be conductive with other lamps of the string lamp, so that the LED lamps of the whole string lamp can normally work; when one LED lamp has faults and is pulled out, the elastic element drives the lower end of the first conductive element to shift and enables the two conductive elements to be mutually contacted to be conductive with the current, so that the other Christmas lamps in the string lamp can normally work; in addition, the sheet metal I is arranged between the lower parts of the first conductive element and the second conductive element or the sheet metal II is arranged with the front sides or the back sides of the first conductive element and the second conductive element, when one LED lamp has faults and is pulled out, under the action of the sheet metal I, the first conductive element and the second conductive element are contacted to be conductive with the current, or when one LED lamp has faults and is pulled out, the sheet metal II is conductive with the front sides or the back sides of the first conductive element and the second conductive element, so that the first conductive element and the second conductive element are mutually contacted to be conductive with the current, also, the normal work of other lamps of the string lamp can be ensured.

Compared with the similar lamps, the structure of the lamp is easy to install and manufacture, and is suitable for the batch production, and the lamp with the structure has a small size and light weight, and can save the production cost.

DETAILED DESCRIPTION OF THE INVENTION

Figure 1:
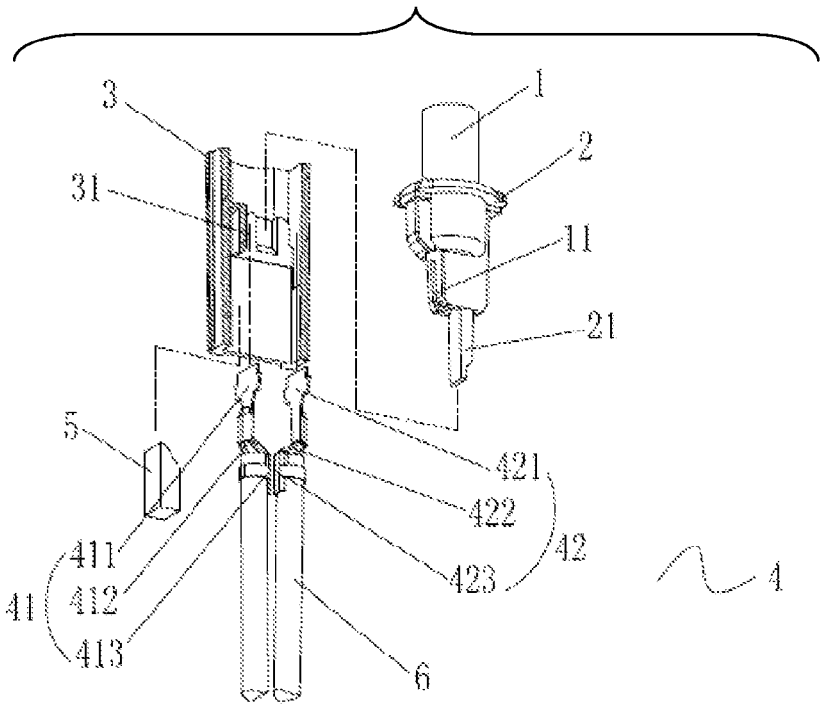
FIG. 1 is a breakdown structure schematic drawing of the embodiment 1 of the utility model.
Figure 2:
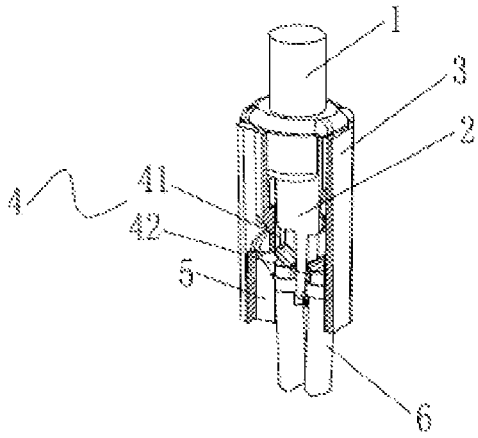
FIG. 2 is an internal structure schematic drawing of the embodiment 1 of the utility model.

In order to facilitate understanding of the skilled in the art, the further detail of the structural principle of the utility model, according to the specific embodiments and drawings, are as follows:

Embodiment 1 according to FIGS. 1~7, the lamp for use in light strings disclosed by the scheme comprises an LED lamp 1, a lamp stem 2 connected with the LED lamp 1 and a lamp holder 3 at which the lamp stem 2 is arranged, wherein the lamp holder 3 is internally provided with a conductive element 4 electrically connected with wires 6, the LED lamp 1 is connected with the conductive element 4 through the lamp stem 2, and a plurality of lamps can be connected in series to form a string lamp.

Wherein the conductive element 4 comprises a first conductive element 41 and a second conductive 42 which are positioned at the left side and the right side in the lamp holder 3, the first conductive element 41 and the second conductive 42 are distributed in a splay entrance shape, one end of the two conductive element 4 is fixedly clamped in preset installation slot 31 in the lamp holder 3 to respectively form fixed ends 411 and 421 connected with the lamp bases 11 of the LED lamp.

The other ends of the two conductive elements 4 are suspended movable ends 412 and 422, the side walls of the movable ends 412 and 422 of the two conductive elements 4, which are mutually closed, are electric contacts 413 and 423 which can be contacted to realize the conduction, the movable ends 412 and 422 of the two conductive elements 4 are fully enclosed or semi-enclosed on wires 6, the first conductive element 41 is connected with the lamps positioned at the front part of the string lamp through the wires 6, the second conductive element 42 is connected with the lamps positioned at the back part of the string lamp through the wires 6, the two lamp bases 11 of the LED lamp 1 are respectively contacted with and conductive with the first conductive element 41 and the second conductive element 42, the lower part of the lamp stem 2 is provided with a protruded end 21, the protruded end 21 is clamped between the movable ends 412 and 422 of the two conductive elements 4, the protruded end 21 of the lamp stem 2 separates the movable ends 412 and 422 of the two conductive elements 4, the current is conductive to the LED lamp 1 through the first conductive element 41 from the wires 6 so as to maintain the normal work of the LED lamp 1, at the same time, the current flows from the second conductive element 42 to the wires 6 to be conductive to the next serial lamp, in this way, the lamps are connected from front to back, so that the normal work of the whole string lamp can be maintained.

In the embodiment, an elastic element 5 is arranged in the gaps among the inner wall of the lamp holder 3 and the movable ends 412 and 422 of the conductive element 4, the elastic element 5 can be an elastic rubber plug, when the LED lamp 1 normally works, the protruded end of the lamp stem 2 separates the movable ends 412 and 422 of the conductive elements 4; at the same time, the elastic element 5 is compressed downwards to the inner wall of the lamp holder 3 under the downward crush action of the lamp stem 2; when the LED lamp 1 has faults and can not normally work, the LED lamp 1 and the lamp stem 2 are pulled out from the lamp holder 3, under the own elastic force, the elastic element 5 recovers to be in the state before being compressed; at the same time, the elastic element 5 drives the first conductive element 41 to move to the second conductive element 42 until the first conductive element 41 and the second conductive element 42 are mutually contacted to be conductive with the current, the current can not pass through the LED lamp 1 which has faults, but is directly conductive to the next lamp through the second conductive element 42 from the first conductive element 41.

Figure 3:
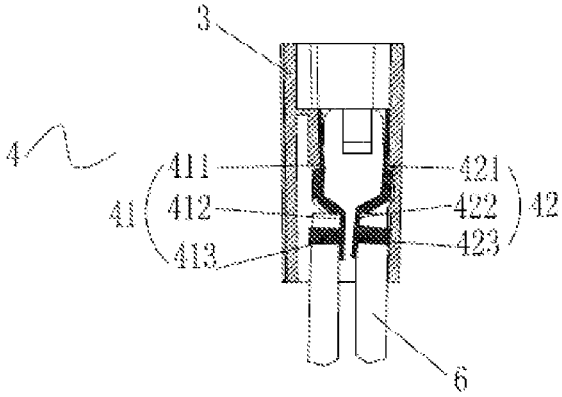
FIG. 3 is a front section view structural schematic drawing of the embodiment 1 of the utility model, in which, the LED lamp, the lamp stem and the elastic element are not installed in the lamp holder.
Figure 4:
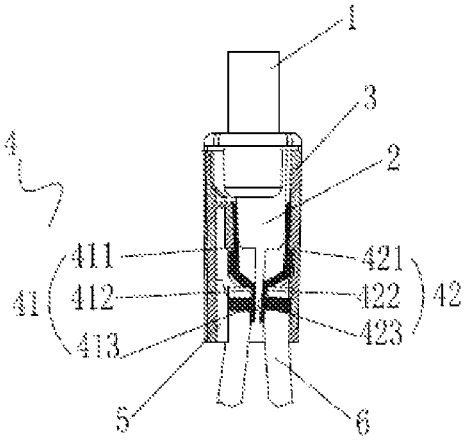
FIG. 4 is a front section view structural schematic drawing of the embodiment 1 of the utility model, in which, the LED lamp, the lamp stem and the elastic element are installed in the lamp holder.
Figure 5:
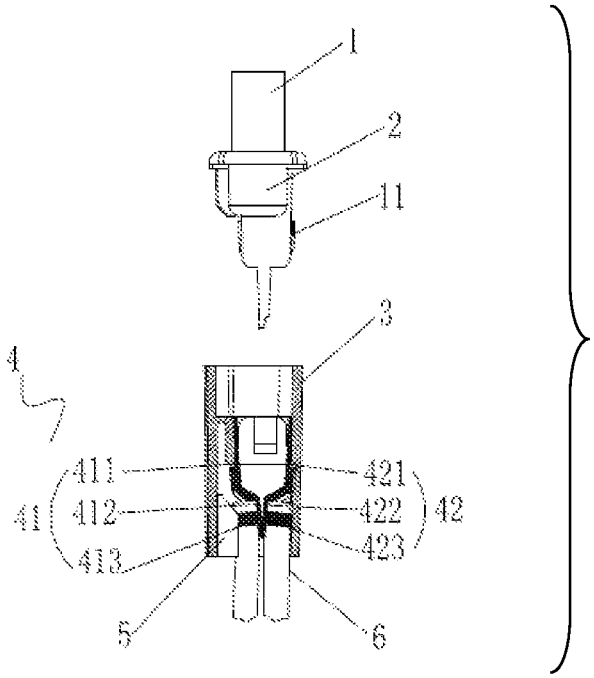
FIG. 5 is the structural schematic drawing of the embodiment 1 of the utility model, in which, the LED lamp and the lamp stem are separated.

In the embodiment, according to FIG. 3, when the LED 1, the lamp stem 2 and the elastic element 5 are installed in the lamp holder 3, the fixed ends 411 and 421 of the two conductive elements 4 are fixed in the installation slot 31 of the lamp holder 3, a gap is left between the movable ends 412 and 422 of the conductive elements 4; according to FIG. 5, when the elastic element 5 is installed in the gap among the inner wall of the lamp holder 3 and the movable ends 412 or 422 of the conductive elements 4, the first conductive element 41 moves toward the second conductive element 42 until the first conductive element 41 contacted with the second conductive element 42; according to the FIG. 4, the LED lamp 1 and the lamp stem move downwards to be installed in the lamp holder until the protruded end 21 of the lamp holder 2 separates the movable ends 412 and 422 of the two conductive elements 4, under the downward crush action of the lamp stem 2, the elastic element 5 is compressed downwards in the lamp holder 3, and the fixed ends 411 and 421 of the two conductive elements 4 are contacted with and conductive with the lamp bases 11 of the LED lamp 1.

Figure 6:
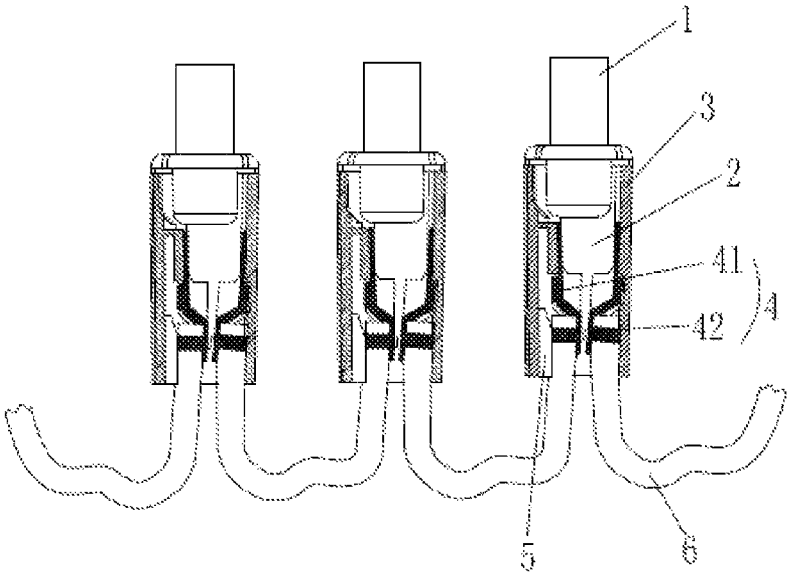
FIG. 6 is a structural schematic drawing of the embodiment 1 of the utility model, in which, a plurality of lamps are connected and normally work.
Figure 7:
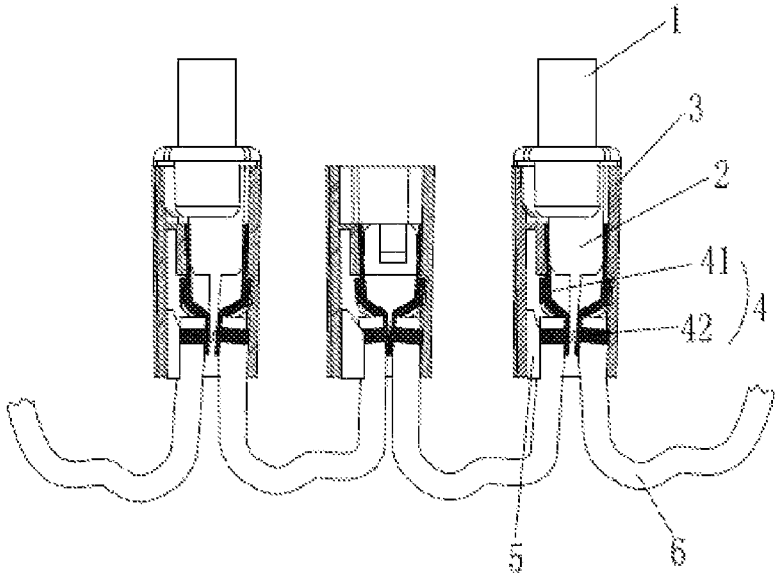
FIG. 7 is a structural schematic drawing of the embodiment 1 of the utility model, in which, a plurality of lamps are connected for the use when one lamp has faults.

In the embodiment, the protruded end 21 of the lamp stem 2 separates the two movable ends 412 and 422 of the conductive elements 4; according to FIG. 6, a plurality of lamps are connected in series to form a string lamp, the current flows through the LED lamp 1 through the conductive element 4 to be conductive with other lamps of the string lamp, so that the normal work of the lamps of whole string lamp can be ensured. When one serial string lamp has faults, according to FIG. 7, the LED lamp 1 is pulled out, the elastic element 5 drives the first conductive element 41 to move to the second conductive element 42 until the first conductive element 41 and the second conductive element 42 are directly contacted to be conductive with the current, so that the other lamps of the string lamp can normally work and be used; at the same time, compared with the structures of other similar lamps, the structure of the lamp is easy to install and manufacture, and is suitable for the batch production, and the lamp with structure has small size and light weight, and can save production cost.

The LED lamp 1 of the lamp Of the utility model can be replaced by common tungsten filament.

Figure 8:
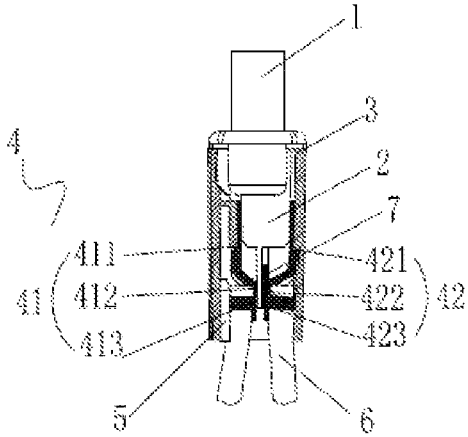
FIG. 8 is a front section view structural schematic drawing of the embodiment 2 of the utility model, in which, the LED lamp, the lamp stem, the elastic element and the sheet metal I are installed in the lamp holder.
Figure 9:
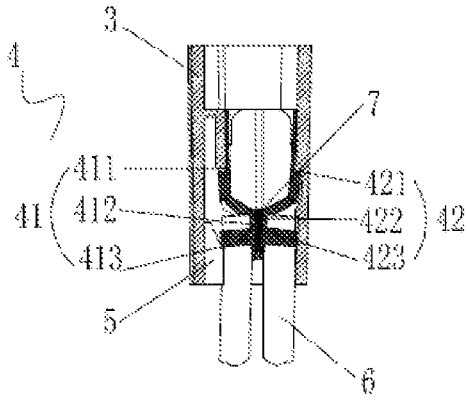
FIG. 9 is a front section view structural schematic drawing of the embodiment 2 of the utility model, in which, the LED lamp and the lamp stand are pulled out.
Figure 10:
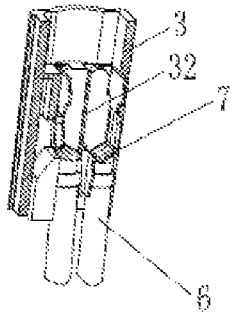
FIG. 10 is a three-dimension structural schematic drawing of the embodiment 2 of the utility model, in which, the LED lamp and the lamp stem are pulled out.

Embodiment 2 according to FIGS. 8~10, the structure of the lamp disclosed by the embodiment is similar to the structure of the embodiment I, and the difference is that a sheet metal I 7 is arranged between the movable ends 412 and 422 of the two conductive elements 4.

In the embodiment, a sheet metal I 7 is arranged between the movable ends 412 and 422 of the first conductive element 41 and the second conductive element 42. The sheet metal I 7 is linear, a clamping slot 32 is arranged in the lamp holder 3, the sheet metal I 7 is directly inserted in the clamping slot 32 of the lamp holder 3 to be fixed, the sheet metal I 7 is positioned in the lamp holder 3, one surface of the sheet metal I 7 is contacted with the side of the protruded end 21 of the lamp stem 2, and the other surface of the sheet metal I 7 is contacted with the electric contacts 413 and 423 of the conductive element 4. When the protruded end 21 of the lamp holder 2 is stretched into the movable ends 412 and 422 of the conductive element 4 to separate the linear sheet metal I 7 and the conductive element 4; according to FIG. 8, a plurality of lamps are connected in series into a string lamp, the current flows through the LED lamp 1 through the conductive element 4 to be conductive with other lamps of the string lamp, so that the normal work of lamps of whole string lamp can be ensured; when one LED lamp 1 has faults and is pulled out, the elastic element 5 drives the movable end 412 of the first conductive element 41 to shift to the linear sheet metal I 7, the linear sheet metal I 7 shifts to the movable end 422 of the second conductive element 42, according to FIG. 9, so that the first conductive element 41 and the second conductive element 42 are contacted to be conductive with the current through the linear sheet metal I 7, also, the normal work of other lamps of the string lamp can be ensured.

Figure 11:
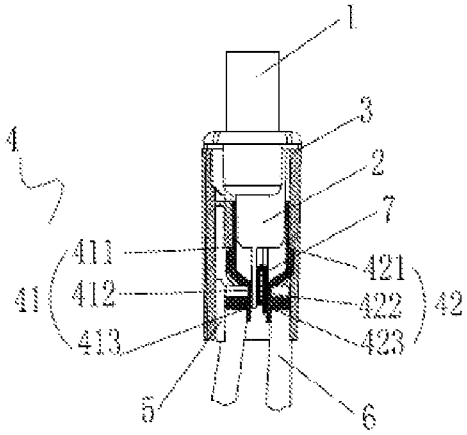
FIG. 11 is a front structural schematic drawing of the embodiment 3 of the utility model, in which, the LED lamp, the lamp stem, the elastic element and the sheet metal I are installed in the lamp holder.
Figure 12:
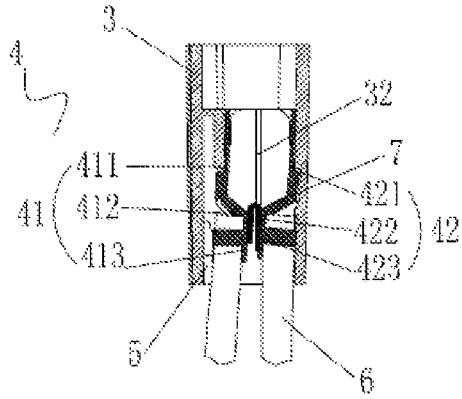
FIG. 12 is a front structural schematic drawing of the embodiment 3 of the utility model, in which, the LED lamp and the lamp stem are pulled out.

Embodiment 3 according to FIGS. 11~12, the structure of the lamp of the embodiment is similar to the structure in the embodiment 2, and the difference is that the sheet metal I 7 is an inverted U-shape.

In the embodiment, the sheet metal I 7 is an inverted U-shape, the inverted U-shaped sheet metal I 7 is elastic, when the protruded end 21 of the lamp stem 2 of the lamp is stretched into the movable ends 412 and 422 of the conductive element 4 to separate the inverted U-shaped sheet metal I 7 and the conductive element 4, according to FIG. 11, a plurality of lamps are connected in series to form a string lamp, the current flows through the LED lamp 1 through the conductive element 4 to be conductive with the other lamps of the string lamp, so that the normal work of the lamps of whole string lamp can be ensured; when one LED lamp 1 has faults and is pulled out, one end of the inverted U-shaped sheet metal I 7 drives the conductive element 41 to shift to the elastic element 5, the inverted U-shaped sheet metal I 7 is contacted with the first conductive element 41 so as to be conductive with the current, according to FIG. 12, also, the normal work of other lamps of the string lamp can be ensured.

Figure 13:
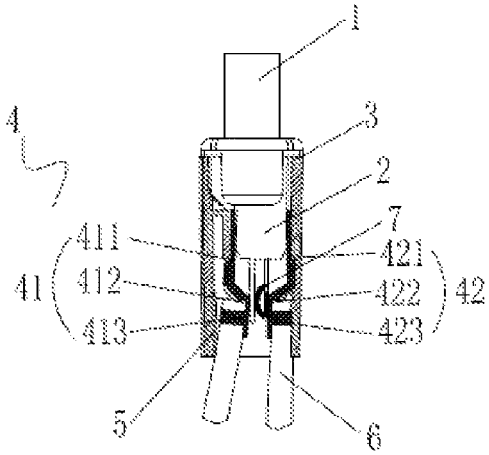
FIG. 13 is a front structural schematic drawing of the embodiment 4 of the utility model, in which, the LED lamp, the lamp stem, the elastic element and the sheet metal I are installed in the lamp holder.
Figure 14:
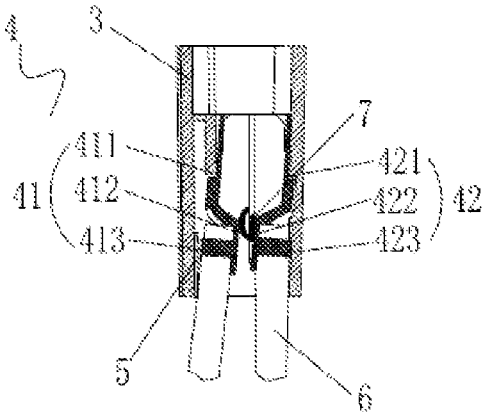
FIG. 14 is a front structural schematic drawing of the embodiment 4 of the utility model, in which, the LED lamp and the lamp stem are pulled out.

Embodiment 4 according to FIGS. 13-14, the structure of the lamp of the embodiment is similar to the structure in embodiment 3, and the difference is that the sheet metal I 7 is G-shaped.

In the embodiment, the sheet metal I 7 is G-shaped, the G-shaped sheet metal I 7 is elastic, when the protruded end 21 of the lamp stem 2 of the lamp is stretched into the movable ends 412 and 422 of the conductive element 4 to separate the O-shaped sheet metal I 7 and the conductive element 4, according to FIG. 13, a plurality of lamps are connected in series to form a string lamp, the current flows through the LED lamp I through the conductive element 4 to be conductive with the other lamps of the string lamp, so that the normal work of the lamps of whole string lamp can be ensured; when one LED lamp 1 has faults and is pulled out, one end of the G-shaped sheet metal I 7 drives the conductive element 41 to shift to the elastic element 5, the O-shaped sheet metal I 7 is contacted with the first conductive element 41 so as to be conductive with the current, according to FIG. 14, also, the normal work of other lamps of the string lamp can be ensured.

Figure 15:
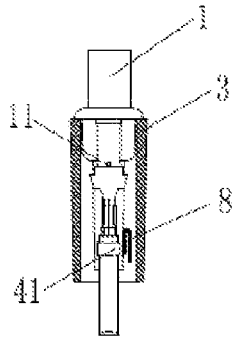
FIG. 15 is a front section view structural schematic drawing of the embodiment 5 of the utility model, in which, the LED lamp, the lamp stem, the elastic element and the sheet metal II are installed in the lamp holder.
Figure 16:
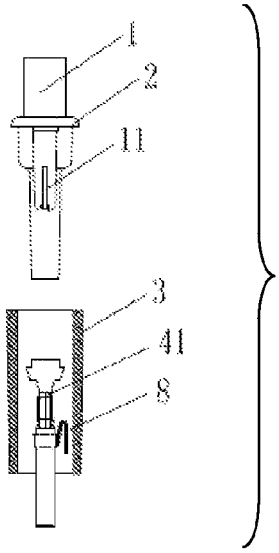
FIG. 16 is a front structural schematic drawing of the embodiment 5 of the utility model, in which, the LED lamp and the lamp stem are separated from each other.
Figure 17:
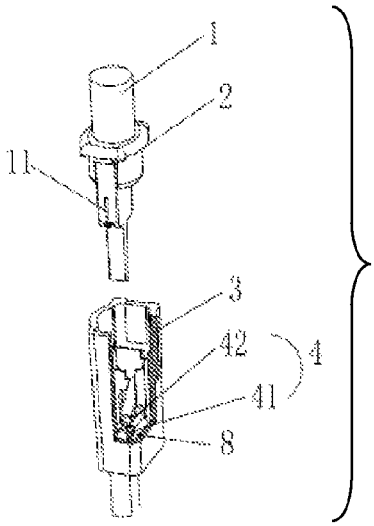
FIG. 17 is a three-dimension structural schematic drawing of the embodiment 5 of the utility model, in which, the LED lamp and the lamp stem are separated from each other.

Embodiment 5 according to FIGS. 15~17, the structure of the lamp of the embodiment is similar to the structure in the embodiment 1, and the difference is that the sheet metal II 8 is arranged at the front sides or the back sides of the first conductive element 41 and the second conductive element 42.

In the embodiment, the sheet metal II 8 is arranged at the front sides or the back sides of the first conductive element 41 and the second conductive element 42. The sheet metal. II 8 is inverted U-shaped, and the inverted U-shaped sheet metal I 7 is elastic, the sheet metal II 8 is respectively contacted with the sides or of the first conductive element 41 and the second conductive element 42. When the protruded end 21 of the lamp stem 2 of the lamp is stretched into the movable ends 412 and 422 of the conductive element 4 to separate the conductive element 4, at the same time, the sheet metal II 8 is separated from the sides or of the first conductive element 41 and the second conductive element 42, according to FIG. 15, a plurality of lamps are connected in series to form a string lamp, the current flows through the LED lamp 1 through the conductive element 4 to be conductive with the other lamps of the string lamp, so that the normal work of the lamp of whole string lamp can be ensured; when one LED lamp 1 has faults and is pulled out, the sheet metal II 8 is recovered to the original position, at the same time, the sheet metal II 8 is respectively contacted with the sides of the first conductive element 41 and the second conductive element 42 to be conductive with the current, according to FIG. 16, also, the normal work of other lamps of the string lamp can be ensured.

In addition, the sheet metal II 8 can be arranged at the sides and the back sides of the first conductive element 41 and the second conductive element 42 in the lamp holder 3.

The above embodiment is the preferable embodiment of the utility model, and in addition, the utility model has other embodiments. It is noted that any obvious alternative should fall in the protection scope of the utility model without departing from the intensive concept.

What is claimed is:

1. A lamp for use in light strings comprises:

an LED lamp;

a lamp stem connected with the LED lamp; and a lamp holder in which the lamp stem is arranged;

wherein the lamp holder is internally provided with a conductive element electrically connected with wires, the LED lamp is connected with the conductive element through the lamp stem, and the conductive element comprises a first conductive element and a second conductive element which are positioned at the left side and the right side in the lamp holder;

wherein the lower part of the lamp stem is provided with a protruded end, the protruded end is clamped between the two conductive elements, the two lamp bases of the LED lamp are respectively contacted with and conductive with the two conductive elements, and the inner wall of the lamp holder is provided with an elastic element which can enable the two conductive elements to be mutually contacted with and conductive with the current when the lamp is pulled out;

wherein the elastic element is positioned in the gap among the inner wall of the lamp holder and movable ends of the conductive ends.

2. The lamp of claim 1, wherein one end of each conductive element is fixedly clamped in the lamp holder to respectively form fixed ends which are contacted with the two lamp bases of the LED lamp, the other ends of the two conductive elements are suspended movable ends which are connected with the wires.

3. The lamp of claim 2, wherein the movable ends of the two conductive elements are fully enclosed or semi-enclosed on wires, and the side walls of the movable ends of the two conductive elements, which are mutually closed, are electric contacts which realize the contact and conduction.

4. The lamp of claim 3, wherein a sheet metal I which can enable the electric contacts of the movable ends of the two conductive elements to conductive.

5. The lamp of claim 4, wherein a clamping slot is arranged in the lamp holder, and the sheet metal I is directly clamped in the clamping slot.

6. The lamp of claim 5, wherein the cross section of the sheet metal I is linear, or G-shaped or inverted U-shaped.

7. The lamp of claim 3, wherein the lamp holder is internally provided with a sheet metal II which can enable the electric contacts of the movable ends of the conductive elements to be conductive, and the sheet metal II is respectively contacted with the front sides or the back sides of the first conductive element and the second element.

* * * * *